US009692179B2

(12) United States Patent
Jaworek

(10) Patent No.: US 9,692,179 B2
(45) Date of Patent: Jun. 27, 2017

(54) PLUG CONNECTOR ASSEMBLY

(71) Applicant: Kostal Kontakt Systeme GmbH, Luedenscheid (DE)

(72) Inventor: Christian Jaworek, Meschede (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 15/176,880

(22) Filed: Jun. 8, 2016

(65) Prior Publication Data

US 2017/0025790 A1 Jan. 26, 2017

Related U.S. Application Data

(63) Continuation of application No. PCT/EP2014/078482, filed on Dec. 18, 2014.

(30) Foreign Application Priority Data

Dec. 20, 2013 (DE) ..... 10 2013 022 011

(51) Int. Cl.
*H01R 13/40* (2006.01)
*H01R 13/629* (2006.01)
(Continued)

(52) U.S. Cl.
CPC ..... *H01R 13/62938* (2013.01); *H01R 13/506* (2013.01); *H01R 13/5219* (2013.01); *H01R 13/629* (2013.01)

(58) Field of Classification Search
CPC ..... H01R 13/5208; H01R 13/5205; H01R 13/5221; H01R 13/521
(Continued)

(56) References Cited

U.S. PATENT DOCUMENTS 4,621,883 A * 11/1986 Noguchi ..... H01R 13/5219 439/271
4,944,688 A * 7/1990 Lundergan ..... H01R 13/5221 439/275
(Continued)

FOREIGN PATENT DOCUMENTS

DE 20013285 U1 12/2001
DE 10128183 A1 8/2002
(Continued)

OTHER PUBLICATIONS

European Patent Office, International Search Report for corresponding International Application No. PCT/EP2014/078482, mailed Mar. 10, 2015.

*Primary Examiner* — Hien Vu
(74) *Attorney, Agent, or Firm* — Brooks Kushman P.C.

(57) ABSTRACT

A connector assembly includes a first plug connector housing in which a first plug contact is arranged, a second plug connector housing, and a seal. The second connector housing includes a protective enclosure, a contact carrier insert in which a second plug contact is fixedly arranged, and a lever. The protective enclosure and the contact carrier insert are movable relative to one another. While the contact carrier insert is connected to the first connector housing with the first and second plug contacts being joined together the protective enclosure moves relative to the contact carrier insert in a direction toward the first connector housing during an actuation of the force-amplifying means to compress the seal between the protective enclosure, the contact carrier insert, and the first connector housing.

12 Claims, 6 Drawing Sheets

(51) Int. Cl.
*H01R 13/506* (2006.01)
*H01R 13/52* (2006.01)

(58) Field of Classification Search
USPC ..... 439/587, 589, 357, 358
See application file for complete search history.

(56) References Cited

U.S. PATENT DOCUMENTS

| | | | | |
|---|---|---|---|---|
| 6,371,778 | B1 | 4/2002 | Watanabe | |
| 7,044,762 | B1 * | 5/2006 | Hong | H01R 13/6275 439/275 |
| 7,059,901 | B2 * | 6/2006 | Morita | H01R 13/645 439/271 |
| 7,232,323 | B2 | 6/2007 | Mohs et al. | |
| 7,244,133 | B2 * | 7/2007 | Muller | H01R 13/5202 439/272 |
| 2007/0049088 | A1 | 3/2007 | Mohs et al. | |
| 2007/0249206 | A1 | 10/2007 | Ishikawa | |

FOREIGN PATENT DOCUMENTS

| | | | |
|---|---|---|---|
| DE | 102005040952 | A1 | 3/2007 |
| DE | 102008012925 | A1 | 9/2009 |
| JP | 2007287614 | A | 11/2007 |

* cited by examiner

PLUG CONNECTOR ASSEMBLY

CROSS-REFERENCE TO RELATED APPLICATIONS

This application is a continuation of International Application No. PCT/EP2014/078482, published in German, with an International filing date of Dec. 18, 2014, which claims priority to DE 10 2013 022 011.4, filed Dec. 20, 2013; the disclosures of which are hereby incorporated in their entirety by reference herein.

TECHNICAL FIELD

The present invention relates to a plug connector assembly having first and second plug connector housings in which first and second electrical plug contacts are respectively located, the second connector housing having a protective enclosure, a contact carrier insert having receiving openings for receiving plug contacts, and force-amplifying means, the protective enclosure and the contact carrier insert slide with respect to one another by the force-amplifying means, the connector housings respectively have housing walls, sections of the housing walls being mutually parallel when the connector housings are connected together, and a seal is between these sections of the housing walls.

BACKGROUND

DE 10 2008 012 925 A1 describes a plug connector assembly like the plug connector assembly set forth above in the Technical Field.

A joining force composed of contact force components is applied to connect together the first and second plug connector housings of the connector assembly. First contact forces are applied initially between the first and second plug contacts. To establish a secure electrical connection between the first plug contacts with the second plug contacts, the first (or alternatively the second) plug contacts are introduced into the corresponding connector housing with spring pressure (i.e., first (or alternatively the second) plug contacts are resilient). Second contact forces press housing parts of the connector housings against a seal. This compresses the seal to produce proper sealing. Furthermore, friction forces that arise mechanically between the connector housings can be kept small by a low tolerance design of the housing parts.

The sum of the contact forces increases with the amount of plug contacts to be connected in a connector assembly. Thus, mechanical means are provided in plug connector assemblies, especially in four-pole plug-in connector assemblies. This is illustrated, for example, in DE 101 28 183 B4 (corresponding to U.S. Pat. No. 6,371,778) by a lever mechanism for connecting four-pole plug-in connector components. Since the connection of the plug contacts takes place concurrently with the compression of the seal, the forces applied during the joining process are considerable. The longest possible lever arm length is therefore required for comfortable handling. This results in a relatively bulky and cumbersome lever mechanism.

Alternatively, so-called zero-force (zero-insertion force) plug connectors have been developed. DE 10 2005 040 952 A1 (corresponding to U.S. Pat. No. 7,232,323) describes an example of a zero-force plug connector. In such connectors the contact forces are generated only in the final part of the joining path by sliding clamping sleeves onto female contacts. As such, no contact forces are applied over most of the joining path. Radial compression of the seal takes place through the joining of the plug connector housing and coincides with the phase of sliding the clamping sleeves. This final joining phase requires a significant actuation force, which is especially difficult in four-pole plug-in connectors.

Another possibility includes compressing the connector housing in a first phase of joining the connector housing, and only afterwards, in a second joining phase, actuating the clamping sleeves of the zero-force plug connector. The sealing force and the contact forces of the electrical contacts are thereby applied sequentially and are thus decoupled from one another. In the above mentioned DE 10 2008 012 925 B4 such a plug-in connector has been described in which a clamping sleeve mechanism (e.g., a collet mechanism) can be actuated by a force-amplifying slider.

In the plug connector assemblies of DE 10 2005 040 952 A1 and DE 10 2008 012 925 B4 the use of so-called zero-force plug connectors is intended. Zero-force plug connectors are quite costly due to their relatively complex clamping mechanism.

SUMMARY

An object includes a simple and cost-effective plug connector assembly in which the generation of sealing and contacting forces is decoupled.

In carrying out at least one of the above and/or other objects, a connector assembly including a first plug connector housing in which a first plug contact is arranged, a second plug connector housing, and a seal is provided. The second connector housing includes a protective enclosure, a contact carrier insert in which a second plug contact is fixedly arranged, and a lever. The protective enclosure and the contact carrier insert are movable relative to one another. While the contact carrier insert is connected to the first connector housing with the first and second plug contacts being joined together the protective enclosure moves relative to the contact carrier insert in a direction toward the first connector housing during an actuation of the force-amplifying means to compress the seal between the protective enclosure, the contact carrier insert, and the first connector housing.

In embodiments, the first and second plug contacts join together as the contact carrier insert is connected to the first connector housing.

In embodiments, the contact carrier insert includes a locking lever and the first connector housing includes a latching lug. The contact carrier insert is connected to the first connector housing by the locking lever being engaged to the latching lug.

In embodiments, the protective enclosure has at least one housing wall and the contact carrier insert has at least one housing wall. The seal is arranged between sections of the at least one housing walls of the protective enclosure and the contact carrier insert. The seal compresses between the at least one housing walls of the protective enclosure and the contact carrier insert and the first connector housing when the protective enclosure moves relative to the contact carrier insert in the direction toward the first connector housing while the contact carrier insert is connected to the first connector housing. The seal compresses axially as the protective enclosure moves relative to the contact carrier insert in the direction toward the first connector housing and is thereby widened radially and pressed against the at least one housing walls of the protective enclosure and the contact carrier insert.

In embodiments, the force-amplifying means includes a lever pivotably connected to the contact carrier insert. The lever may be bow-shaped. The actuation of the force-amplifying means involves pivoting the lever. The protective enclosure may include guide pins and the lever may include guide paths. The guide pins of the protective enclosure are received in the guide paths of the lever. The guide pins are movable along the guide paths as the lever pivots.

In embodiments, the actuation of the force-amplifying means is a rotational or sliding actuation of the force-amplifying means.

In embodiments, the force-amplifying means is a slider movable perpendicular to a direction of insertion of the connector housings.

In carrying out at least one of the above and/or other objects, another connector assembly is provided. This connector assembly includes a first plug connector housing in which a first plug contact is arranged, a second plug connector housing, and a seal extending around a portion of the contact carrier insert. The second connector housing includes a contact carrier insert having a receiving opening in which a second plug contact is fixedly arranged, a protective enclosure extending over at least a part of the contact carrier insert, and a bow-shaped lever pivotably connected to the contact carrier insert. The protective enclosure and the contact carrier insert are movable relative to one another. While the contact carrier insert is inserted into the first connector housing and is connected to the first connector housing with the first and second plug contacts being joined together the protective enclosure moves in a direction toward the first connector housing further over the contact carrier insert during a pivoting of the lever to compress the seal between the protective enclosure, the contact carrier insert, and the first connector housing.

An embodiment provides an electrical plug connector assembly having first and second plug connector housings in which first and second electrical plug contacts are respectively arranged. The second connector housing includes a protective enclosure, a contact carrier insert, and force-amplifying means such as a lever. The protective enclosure and the contact carrier insert can be moved in relation to one another by the force-amplifying means. The contact carrier insert has receiving openings for receiving the second plug contacts. The connector housings each have at least one housing wall. The housing walls have sections parallel to one another when the connector housings are interconnected. A seal is arranged between these sections of the housing walls. The seal abuts at least one housing wall of each of the connector housings when the connector housings are interconnected. The second plug contacts are arranged immovably in relation to the contact carrier insert. The contact carrier insert can be locked to the first connector housing. The protective enclosure can be moved in relation to the contact carrier insert by a rotational or translational actuation of the force-amplifying means.

In embodiments, the second plug contacts are arranged to be immovable with respect to the contact carrier insert, the contact carrier insert is latched to the first plug connector housing, and the protective enclosure is displaced with respect to the contact carrier insert by a rotational or sliding action of the force-amplifying means.

The compression of the seal is carried out only after the complete joining of the plug contacts which advantageously form no zero insertion force plug connector and can thus be manufactured in a cost-effective manner. The implementation of a plug connector assembly in accordance with embodiments can thus be accomplished advantageously when the amount of plug contacts to be connected is not too large.

A plug connector assembly in accordance with embodiments differs from the plug connector assembly described in DE 10 2008 012 925 B4 as follows. In a plug connector assembly in accordance with embodiments the second plug contacts immovably arranged in the contact carrier insert of the second connector housing are joined to the first plug contacts arranged in the first connector housing. The first and second plug contacts are joined as the contact carrier insert and the first connector housing are fixedly connected together. The latching between a locking lever of the contact carrier insert with a locking lug of the first connector housing fixedly connects the contact carrier insert to the first connector housing. The protective enclosure of the second connector housing remains movable relative to the contact carrier insert. The force amplifying means are then manipulated to cause the protective enclosure to slide over the contact carrier insert in the direction toward the first connector housing. The sliding of the protective enclosure relative to the contact carrier insert in the direction toward the first connector housing causes the seal arranged between the first and second connector housings to be compressed. The seal is compressed between the protective enclosure, the contact carrier insert, and the first connector housing. The seal is widened radially by an axial compression with respect to the direction of insertion of the plug connector housing (i.e., with respect to a direction from the protective enclosure toward the first connector housing), and is pressed against walls of the connector housings, whereby a moisture-tight seal of the connector housings is achieved.

It is advantageous that a significant compression of the seal can be achieved with a relatively small force being applied, through the force-amplifying means that can preferably be designed as a pivoting lever. The force-amplifying means can alternatively be provided as a slider that can be displaced linearly perpendicular to the direction of insertion with a guide bevel, as is described in DE 10 2008 012 925 B4. In this embodiment, a guide journal coupled to the protective enclosure is moved in the guide bevel by the sliding actuation.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
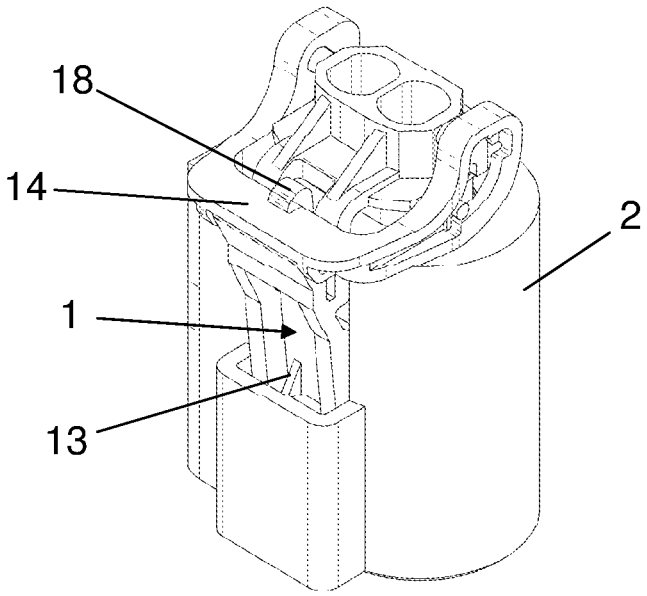
FIG. 1 illustrates a perspective view of an electrical plug connector assembly.

Referring now to FIG. 1, a perspective view of an electrical plug connector assembly is shown. The connector assembly includes a first plug connector housing 1 and a second plug connector housing 2. In the fully assembled stage of the connector assembly as shown in FIG. 1, connector housings 1 and 2 are mutually connected with second connector housing 2 extensively covering first connector housing 1.

Figure 2:
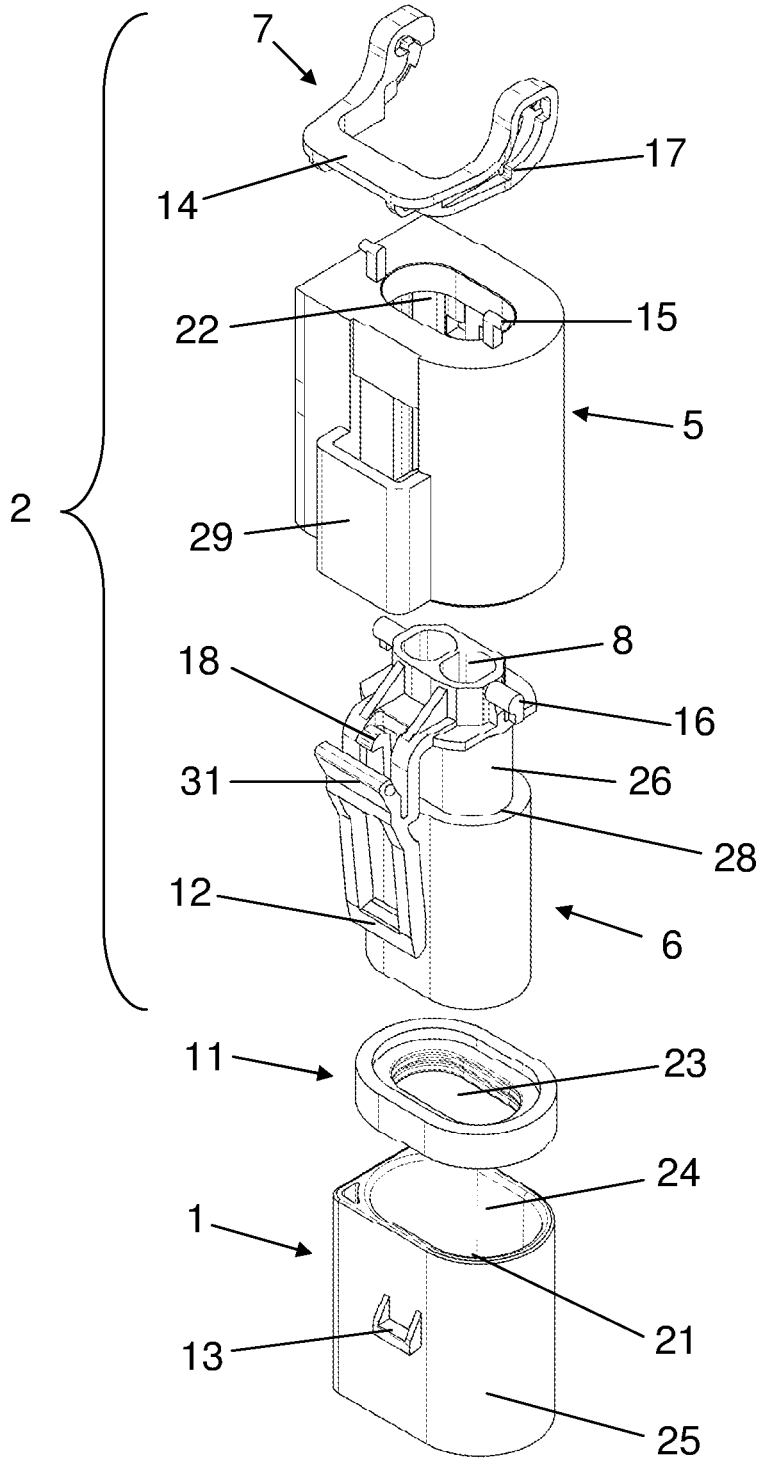
FIG. 2 illustrates an exploded view of the plug connector assembly.

Referring now to FIG. 2, with continual reference to FIG. 1, an exploded view of the plug connector assembly is shown. The connector assembly further includes an annular seal 11. Seal 11 is arranged between connector housing 1 and 2. Seal 11 is tightly compressed when connector housings 1 and 2 are connected to prevent the penetration of moisture into the connector assembly.

Figure 3:
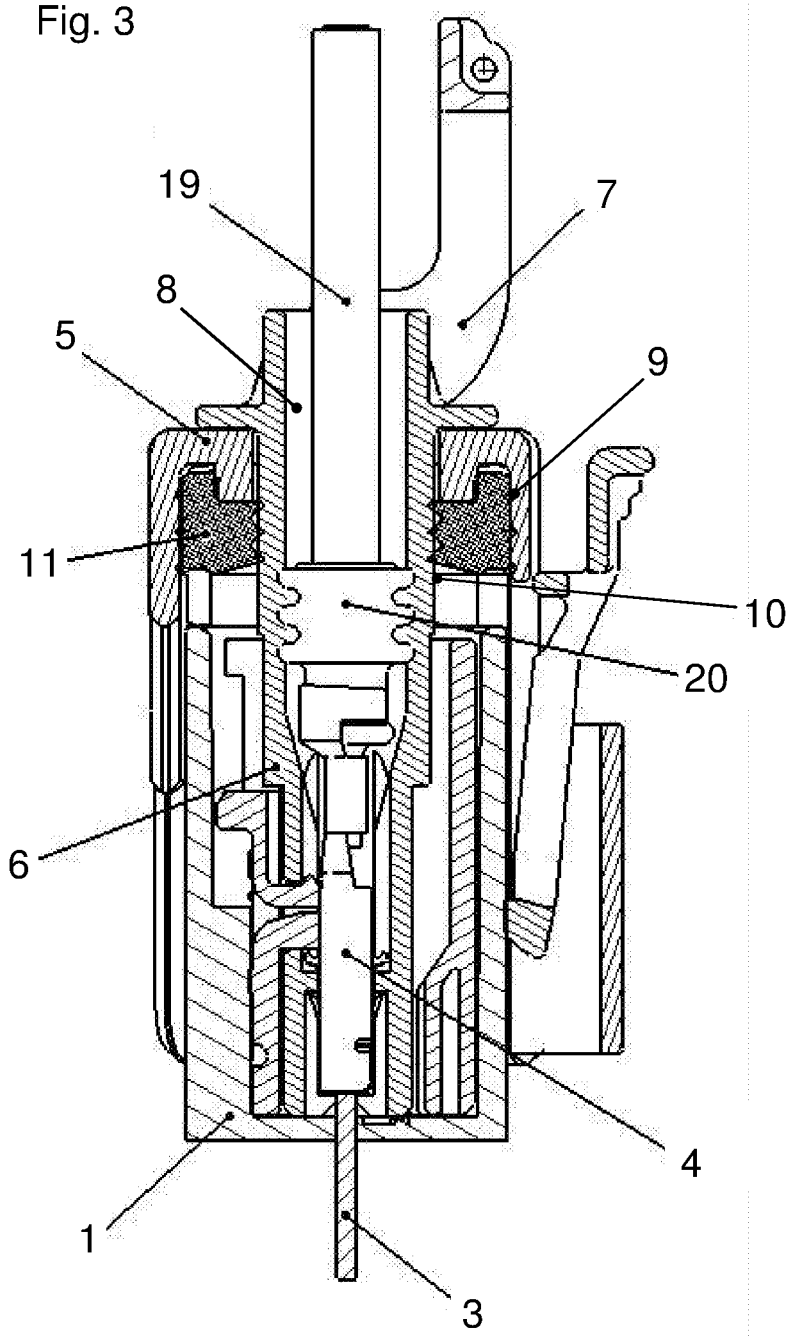
FIG. 3 illustrates a cross-sectional view of the plug connector assembly in an initial stage of assembly.
Figure 4:
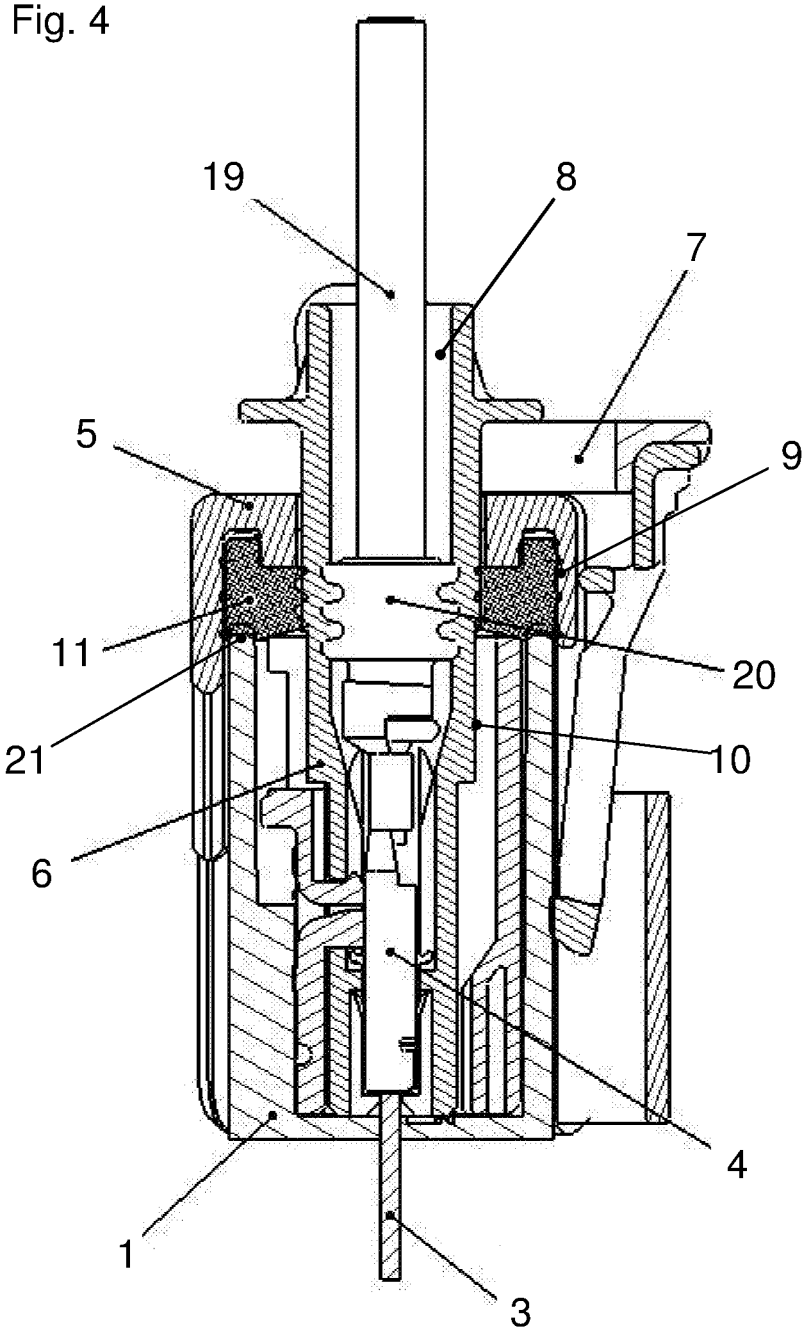
FIG. 4 illustrates a cross-sectional view of the plug connector assembly in a final stage of assembly.

Referring now to the remaining FIGS. 3, 4, 5, 6, 7, 8, and 9, with continual reference to FIGS. 1 and 2, the plug connector assembly will be further described. FIG. 3 illustrates a cross-sectional view of the connector assembly in an initial stage of assembly; and FIG. 4 illustrates a cross-sectional view of the connector assembly in a final stage of assembly. FIGS. 5, 6, 7, 8, and 9 illustrate sectional views of the connector assembly from an initial stage of assembly to a final stage of assembly.

First connector housing 1 includes at least one or more first electrical plug contacts 3 arranged therein and second connector housing 2 includes at least one or more second electrical plug contacts 4 arranged therein (shown in FIGS. 3 and 4). In the illustrated embodiment, first plug contacts 3 are electrical male contact pins and second plug contacts 4 are electrical female contact sockets. In another embodiment, first plug contacts 3 are electrical female contact sockets and second plug contacts 4 are electrical male contact pins.

First connector housing 1 has a circumferentially closed outer surface 25. A locking lug 13 is integrally molded on the outer side of outer surface 25 of first connector housing 1. First connector housing 1 has an insertion aperture 24 extending through a top side of the first connector housing. Outer surface 25 forms a housing edge 21 which bounds insertion aperture 24 at the front side of first connector housing 1. Seal 11 lies on the circumferential edge of housing edge 21 after first and second connector housings 1 and 2 are successfully connected together.

Second connector housing 2 includes a protective enclosure 5, a contact carrier (or support) insert 6, and force amplifying means in the form of a bow-shaped pivotable lever 7. Contact carrier insert 6 includes a receiving opening 8 into which a female contact socket can be introduced. Contact carrier insert 6 further includes a spring-loaded locking lever 12 integrally molded thereon. Locking lever 12 latches with locking lug 13 of first connector housing 1 after connector housings 1 and 2 are connected to form a latching connection between contact carrier insert 6 and first connector housing 1. Contact carrier insert 6 further includes two mutually aligned bearing pins 16 integrally molded thereon.

In order to preassemble second connector housing 2, protective enclosure 5 is slid over contact carrier insert 6. Bearing pins 16 of contact carrier insert 6 protrude out of an opening 22 of protective enclosure 5 when protective enclosure 5 is slid over contact carrier insert 6. Lever 7 is connected pivotably to bearing pins 16.

Lever 7 includes guide paths 17 integrally molded in parallel side surfaces of the lever. Protective enclosure 5 includes integrally molded guide pins 15 adjacent opening 22 of protective enclosure 5. Guide pins 15 of protective enclosure 5 are respectively inserted into guide paths 17 of lever 7. When lever 7 is pivoted about bearing pins 16, guide pins 15 move along guide paths 17 causing protective enclosure 5 and contact carrier insert 6 to slide with respect to one another.

In particular, protective enclosure 5 slides with respect to contact carrier insert 6 when lever 7 is pivoted. When lever 7 is pivoted downward, protective enclosure 5 slides with respect to contact carrier insert 6 in a direction towards first connector housing 1 (compare FIGS. 3 to 4). On the other hand, when lever 7 is pivoted upward, protective enclosure 5 slides with respect to contact carrier insert 6 in a direction away from first connector housing 1 (compare FIG. 4 to FIG. 3).

In order to further preassemble second connector housing 2, seal 11 is slid over the housing chassis of contact carrier insert 6 to rest against a fitted section 26 of contact carrier insert 6. Seal 11 is supported on an edge 28 in a transition region of contact carrier insert 6 to fitted section 26.

Figure 5:
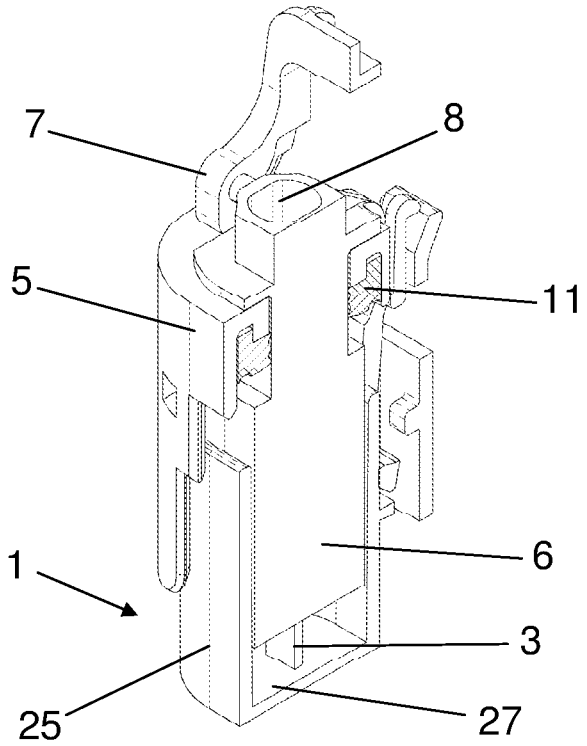

In order to connect second connector housing 2 to first connector housing 1, contact carrier insert 6 is inserted through insertion aperture 24 of first connector housing 1. FIG. 5 illustrates an instantaneous state of this assembly phase. As shown in this sectional view, contact carrier insert 6 is inserted into first connector housing 1, but has not yet arrived at a base plate 27 at a bottom side of first connector housing 1. As such, a part of first plug contact 3 belonging to first connector housing 1 is visible in FIG. 5. Protective enclosure 5 overlaps part of outer surface 25 of first connector housing 1 with its inner surface. Seal 11 is on the inner side of protective enclosure 5.

Figure 6:
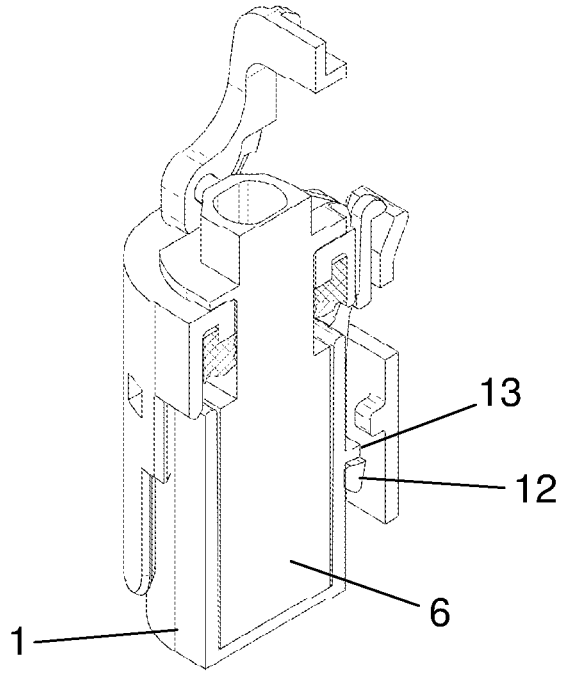

During the joining process of first and second connector housings 1 and 2, the lower front surface of contact carrier insert 6 finally reaches base plate 27 at the bottom side of first connector housing 1. This assembly state is shown in FIG. 6. In the process, spring loaded locking lever 12 connected to contact carrier insert 6 latches to locking lug 13 of first connector housing 1. Contact carrier insert 6 is now fixed to first connector housing 1.

During this joining phase, with the exception of a small force for pivoting locking lever 12, only the contact forces of first and second plug contacts 3 and 4 need to be applied. Plug contacts 3 and 4 are shown suggestively in FIGS. 3 and 4. In this connection, FIG. 3 represents the same assembly state as shown in FIG. 6 in another sectional view.

Plug contacts 3 corresponding to first connector housing 1 are depicted as contact pins in FIG. 3 and plug contacts 4 corresponding to second connector housing 2 form female contacts which are respectively connected to a connector line 19. A rubber seal 20 is arranged respectively around connector line 19 in receiving opening 8 to prevent the penetration of moisture into the plug connector assembly through contact carrier insert 6. Plug contacts 4 are immovably arranged in receiving opening 8 in relation to contact carrier insert 6.

During the insertion of contact carrier insert 6 into first connector housing 1, seal 11 makes no contribution to the joining force to be applied. This is because in this joining phase seal 11 is not compressed by connector housings 1 and 2, as shown in FIG. 3 and FIGS. 5 and 6. Seal 11 lies both on surface sections of protective enclosure 5 and on contact carrier insert 6. Since no relative motion takes place in this joining phase between protective enclosure 5 and contact carrier insert 6, no friction is produced on seal 11 that can make a contribution to the joining force.

Figure 9:
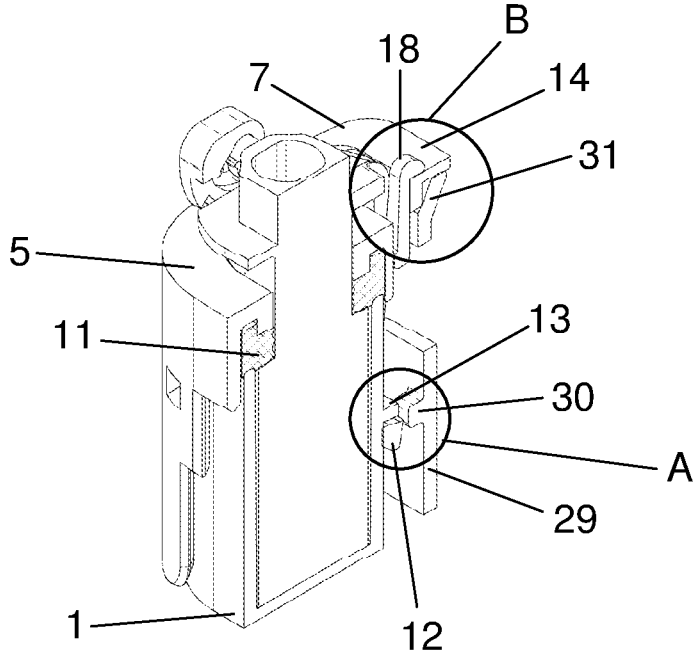
FIGS. 5, 6, 7, 8, and 9 illustrate sectional views of the plug connector assembly in various stages of assembly.
Figure 7:
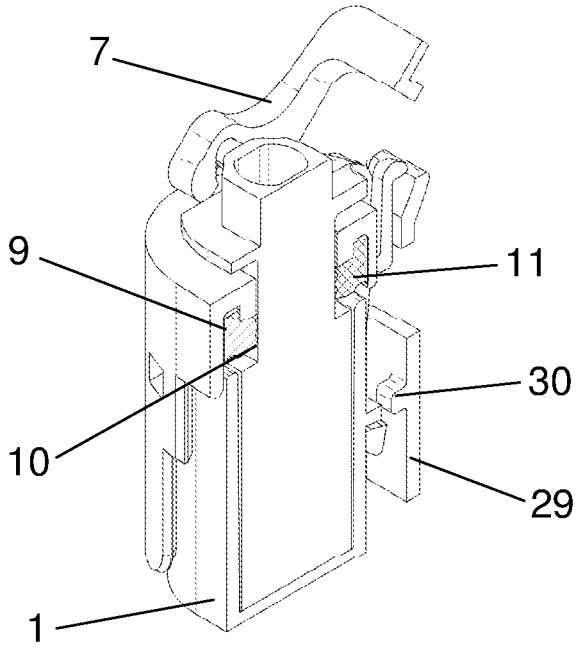
Figure 8:
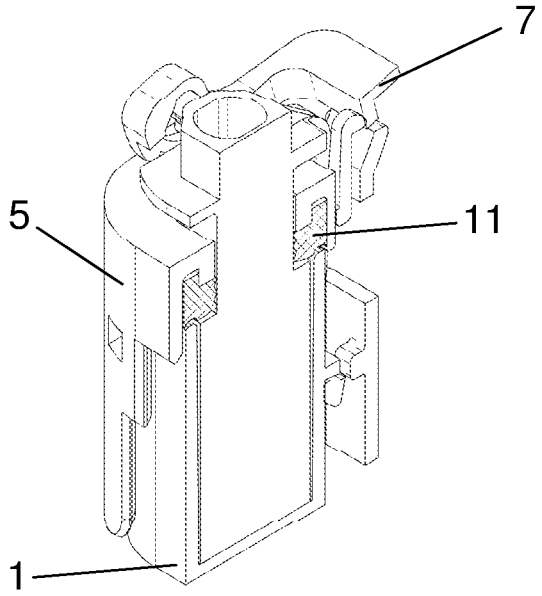

Loading of seal 11 with a force first occurs only after completion of the mating of connector housings 1 and 2 and the associated plug contacts 3 and 4. Loading of seal 11 with a force is done by turning lever 7, for which a sequence at different points in time is shown in FIGS. 7, 8, and 9.

Protective enclosure 5 slides with respect to contact carrier insert 6 with the motion of guide pins 15 of protective enclosure 5 along guide paths 17 of lever 7. Due to the fixing of contact carrier insert 6 to first connector housing 1 that is produced by the latching of locking lever 12 of contact carrier insert 6 to locking lug 13 of first connector housing 1, protective enclosure 5 is thereby slid against first connector housing 1 in the direction towards first connector housing 1. This causes seal 11 to be compressed axially, meaning that seal 11 is compressed in the connection direction of connector housings 1 and 2. At the same time, the axial compression produces a radial offset of seal 11. Seal 11 is thereby pressed firmly against housing walls 9 and 10 of protective enclosure 5 and contact carrier insert 6.

This is shown best in FIG. 4. In comparison to its position in FIG. 3, protective enclosure 5 is slid downwards against first connector housing 1. This causes seal 11 to be pressed with pressure against housing edge 21 of first connector housing 1, the interior surface of at least one housing wall 9 of protective enclosure 5, and the exterior surface of at least one housing wall 10 of contact carrier insert 6.

A comfortably applied actuation force for moving lever 7 is transformed by its force-amplifying effect into a relatively large pressure force to seal 11 in order to achieve proper sealing. This path is moreover advantageously decoupled from the processes of joining connector housings 1 and 2 and generating the plug contact forces.

After turning lever 7 an actuating section 14 of lever 7 locks tightly to a locking hook 18 of contact carrier insert 6. As a result, the force influence of connector housings 1 and 2 on seal 11 is also unchanged throughout the pivoting lever motion.

As FIGS. 7, 8, and 9 illustrate, a collar 29 of protective enclosure 5 has an injection molded collar projection 30 on its inner side. In the final position of protective enclosure 5 shown in FIG. 9, collar 29 protects the latching connection between locking lever 12 and locking lug 13 (bordered region A in FIG. 9) from an unintended separation. At the same time, actuating section 14 of lever 7 that is engaged with locking hook 18 blocks a handle section 31 of locking lever 12 (bordered region B in FIG. 9). An inadvertent release of the plug-in connector is safely prevented by this double locking of locking lever 12.

In order to separate connector housings 1 and 2 from one another, locking hook 18 is first to be released from actuating section 14 of lever 7. Only after sliding protective enclosure 5 by swinging lever 7 back does collar projection 30 release the latching connection between locking lever 12 and locking lug 13 which can then be triggered by pressure on handle section 31 of locking lever 12.

REFERENCE SYMBOL LIST

1 first plug connector housing
2 second plug connector housing
3 first plug contact
4 second plug contact
5 protective enclosure
6 contact carrier insert
7 pivoting lever (force-amplifying means)
8 receiving opening of the contact carrier insert
9 housing wall of the protective enclosure
10 housing wall of the contact carrier insert
11 seal
12 locking lever of the contact carrier insert
13 locking lug of the first plug connector housing
14 actuating section of the pivoting lever
15 guide pins of the protective enclosure
16 bearing pins of the contact carrier insert
17 guide paths of the pivoting lever
18 locking hook of the contact carrier insert
19 connector line
20 rubber seal
21 housing edge of the first plug connector housing
22 opening of the contact carrier insert
23 opening of the seal
24 insertion aperture of the first plug connector housing
25 outer surface of the first plug connector housing
26 fitted section of the contact carrier insert
27 base plate of the first plug connector housing
28 transition region edge
29 collar of the protective enclosure
30 collar projection
31 locking lever handle section
A, B regions While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electrical connector assembly comprising:

a first plug connector housing in which a first plug contact is arranged;

a second plug connector housing including a protective enclosure, a contact carrier insert in which a second plug contact is fixedly arranged, and a bow-shaped lever pivotably connected to the contact carrier insert to be pivotable relative to the contact carrier insert, the protective enclosure and the contact carrier insert being movable relative to one another;

wherein the protective enclosure includes guide pins thereon, the bow-shaped lever includes guide paths therein, the guide pins are received in the guide paths, and the guide pins move along the guide paths as the bow-shaped lever pivots relative to the contact carrier insert causing the protective enclosure to move relative to the contact carrier insert;

a seal; and wherein, while the contact carrier insert is connected to the first connector housing with the first and second plug contacts being joined together, the protective enclosure and the contact carrier remain movable relative to one another and as the bow-shaped lever pivots relative to the contact carrier insert during an actuation of the bow-shaped lever, the protective enclosure moves relative to the contact carrier insert in a direction toward the first connector housing causing the seal to compress between the protective enclosure, the contact carrier insert, and the first connector housing.

2. The connector assembly of claim 1 wherein:

the first and second plug contacts are joined together as the contact carrier insert is connected to the first connector housing.

3. The connector assembly of claim 1 wherein:

the contact carrier insert includes a locking lever and the first connector housing includes a latching lug; and the contact carrier insert is connected to the first connector housing by the locking lever being engaged to the latching lug.

4. The connector assembly of claim 1 wherein:

the protective enclosure has at least one housing wall and the contact carrier insert has at least one housing wall; and the seal is arranged between sections of the at least one housing walls of the protective enclosure and the contact carrier insert.

5. The connector assembly of claim 4 wherein:

the seal compresses between the at least one housing walls of the protective enclosure and the contact carrier insert and the first connector housing when the protective enclosure moves relative to the contact carrier insert in the direction toward the first connector housing while the contact carrier insert is connected to the first connector housing.

6. An electrical connector assembly comprising:

a first plug connector housing in which a first plug contact is arranged;

a second plug connector housing including a protective enclosure, a contact carrier insert in which a second plug contact is fixedly arranged, and force-amplifying means, the protective enclosure and the contact carrier insert being movable relative to one another;

wherein the protective enclosure has at least one housing wall and the contact carrier insert has at least one housing wall;

a seal arranged between sections of the at least one housing walls of the protective enclosure and the contact carrier insert;

wherein while the contact carrier insert is connected to the first connector housing with the first and second plug contacts being joined together the protective enclosure moves relative to the contact carrier insert in a direction toward the first connector housing during an actuation of the force-amplifying means to compress the seal between the protective enclosure, the contact carrier insert, and the first connector housing with the seal being compressed between the at least one housing walls of the protective enclosure and the contact carrier insert and the first connector housing when the protective enclosure moves relative to the contact carrier insert in the direction toward the first connector housing while the contact carrier insert is connected to the first connector housing; and wherein the seal compresses axially as the protective enclosure moves relative to the contact carrier insert in the direction toward the first connector housing and is thereby widened radially and pressed against the at least one housing walls of the protective enclosure and the contact carrier insert.

7. The connector assembly of claim 6 wherein:

the actuation of the force-amplifying means is a rotational actuation of the force-amplifying means.

8. An electrical connector assembly comprising:

a first plug connector housing in which a first plug contact is arranged;

a second plug connector housing including a contact carrier insert having a receiving opening in which a second plug contact is fixedly arranged, a protective enclosure extending over at least a part of the contact carrier insert, and a bow-shaped lever pivotably connected to the contact carrier insert, the protective enclosure and the contact carrier insert being movable relative to one another;

wherein the protective enclosure has at least one housing wall and the contact carrier insert has at least one housing wall;

a seal extending around a portion of the contact carrier insert and arranged between sections of the at least one housing walls of the protective enclosure and the contact carrier insert;

wherein while the contact carrier insert is inserted into the first connector housing and is connected to the first connector housing with the first and second plug contacts being joined together the protective enclosure moves in a direction toward the first connector housing further over the contact carrier insert during a pivoting of the lever to compress the seal between the protective enclosure, the contact carrier insert, and the first connector housing with the seal being compressed between the at least one housing walls of the protective enclosure and the contact carrier insert and the first connector housing when the protective enclosure moves relative to the contact carrier insert in the direction toward the first connector housing while the contact carrier insert is connected to the first connector housing; and wherein the seal compresses axially as the protective enclosure moves in the direction toward the first connector housing further over the contact carrier insert and is thereby widened radially and pressed against the at least one housing walls of the protective enclosure and the contact carrier insert.

9. The connector assembly of claim 8 wherein:

the first and second plug contacts are joined together as the contact carrier insert is connected to the first connector housing.

10. The connector assembly of claim 8 wherein:

the contact carrier insert includes a locking lever and the first connector housing includes a latching lug; and the contact carrier insert is connected to the first connector housing by the locking lever being engaged to the latching lug.

11. The connector assembly of claim 8 wherein:

the protective enclosure includes guide pins and the lever includes guide paths, the guide pins of the protective enclosure are received in the guide paths of the lever; and the guide pins move along the guide paths as the lever pivots causing the protective enclosure to move relative to the contact carrier insert.

12. The connector assembly of claim 8 wherein:

the first plug contacts are one of male and female plug contacts and the second plug contacts are the other one of male and female plug contacts.

* * * * *